United States Patent [19]

Stoneback

[11] 4,129,228

[45] Dec. 12, 1978

[54] MEDICATION CONTAINER WITH QUICK RELEASE CLOSURE

[76] Inventor: John W. Stoneback, 328 East 262 St., Cleveland, Ohio 44132

[21] Appl. No.: 673,684

[22] Filed: Apr. 5, 1976

[51] Int. Cl.[2] ..... B65D 41/04

[52] U.S. Cl. ..... 220/293; 215/329; 215/350; 215/352; 220/304

[58] Field of Search ..... 206/37, 38, 535, 536; 220/288, 289, 293, 304, 327; 215/283, 329, 349, 350, 352; 85/1 C, 1 T; 220/304

[56] References Cited

U.S. PATENT DOCUMENTS

| | | | |
|---|---|---|---|
| 1,407,335 | 2/1922 | Reynolds | 285/334 |
| 1,637,628 | 8/1927 | Weisgerber | 285/334 |
| 1,661,448 | 3/1928 | Taylor | 85/1 C |
| 2,070,024 | 2/1937 | Perry | 215/349 |
| 2,083,228 | 6/1937 | Geyer | 285/423 |
| 2,173,449 | 9/1939 | Kronman | 215/349 |
| 2,465,662 | 3/1949 | Sanford | 215/349 |
| 2,707,552 | 5/1955 | Matthiesen | 206/537 |
| 2,759,598 | 8/1956 | Tregilgas | 206/537 |
| 3,041,692 | 7/1962 | Olila | 206/38 |
| 3,057,464 | 10/1962 | Baggott, Sr. | 206/536 |
| 3,251,459 | 5/1966 | Lacour | 206/537 |
| 3,283,717 | 11/1966 | Balch | 206/37 R |
| 3,395,642 | 8/1968 | Foster et al. | 220/293 |
| 3,658,368 | 4/1972 | Hohanson | 285/333 |
| 3,923,324 | 12/1975 | Cruickshank | 285/333 |
| 4,004,832 | 1/1977 | Connelly | 285/333 |

*Primary Examiner*—William Price

*Attorney, Agent, or Firm*—Watts, Hoffman, Heinke, and Fisher Co.

[57] ABSTRACT

A medication container is disclosed having structure which is both resistant to interaction with stored medicine and protects the medicine from deterioration. The container maintains the stored medicine available for almost instant self-administration by thw user. Plating is preferably provided to inhibit interaction of the container and the medicine. Alternately, the container is made from a material which is impervious and inert to the stored medicine. The container is configured to accommodate the desired dosage of medication. The preferred container has efficient double sealing to further protect the medicine. The container preferably consists of two members which are selectively secured together by novel threads which require only a small amount of relative rotation between the members for connection and disconnection. The threads are plated and configured to achieve a smooth but tight fit and to avoid bonding or sticking between the threads when the container has been closed. The container members are configured to provide "double pilot" alignment of the two members perparatory to their threaded connection.

14 Claims, 4 Drawing Figures

MEDICATION CONTAINER WITH QUICK RELEASE CLOSURE

BACKGROUND OF THE INVENTION

1. Field of the Invention

This invention relates to containers for medicinal substances, and particularly to such a container which can be worn on the person, for maintaining a dosage of nitroglycerin tablets in a fresh condition and readily available for rapid self-administration by the wearer.

2. Description of the Prior Art

Sufferers from certain heart and circulatory diseases, such as angina pectoris, sometimes incur sudden and serious attacks which require the immediate administration of a dose of nitroglycerin tablets. In a very brief time, an attack can render a person incapable of self-administering the needed medicine. Many such sufferers carry their medication on their person almost constantly.

Nitroglycerin tablets are characterized by a relatively poor shelf life. These tablets will deteriorate with excessive exposure to air. In addition, if the tablets are stored in plastic containers, active ingredients of the tablets tend to exude into pores of the containers. Known metallic containers are also unsatisfactory because constituents of the tablets will react with most metals and, in addition, if the metals are not quite dense, constituents of the tablets will exude into the pores of the metal in a manner corresponding to the deterioration in a plastic bottle.

Because of these characteristics of nitroglycerin tablets, current Federal regulations prohibit the sale of nitroglycerin tablets in any container other than a brown glass container with a screw thread top which will effect a seal. Because of the need for quick access to them, nitroglycerin tablets are exempt from regulations which require tamper-proof closures such as those currently used on containers for aspirin tablets and other medications.

It is these brown glass, screw-top containers that are typically carried by victims of heart and other circulatory diseases. One suffering from the pain and weakness attendant to a heart attack or an attack of angina can find it quite difficult to locate a bottle of nitroglycerin tablets in a pocket or purse and to then unscrew the sealed cap in time to self-administer tablets before, for example, losing consciousness.

A related problem is that the sufferer has no way of knowing when an attack will occur. Should an attack occur when a sufferer is taking a shower, for example, it is not at all improbable that the sufferer would be unable to get out of the shower, locate the bottle of tablets and put some in his mouth before losing consciousness.

There have been many proposals for personalized pill containers. Many of these are intended to provide a container for a small quantity of a given medication that has been prescribed for an ailment. These proposals would make it relatively convenient to carry a small quantity of quickly and conveniently available medications. While there have been many such proposals, none has been satisfactory for the heart disease victim who is required to carry nitroglycerin tablets. The reason is that none has been satisfactory to maintain the nitroglycerin at an appropriate potency level for a long enough period of time to achieve its intended medicinal function.

SUMMARY OF THE INVENTION

The present invention provides a sealed, but readily openable container for nitroglycerin tablets. The container holds enough tablets to provide emergency medication for a heart disease victim while, at the same time, having a small enough quantity of tablets that administration of the entire contents of the container will not produce harmful results.

The container has threadedly connected cap and body members that are preferably worn as a locket. In the preferred arrangement, two seals are interposed between the members to effect a fluid-tight, but facilely separable, connection.

The body and cap members are screw machine parts of a material which is sufficiently dense and impermeable to inhibit diffusion of constituents in the nitroglycerin tablets into pores in the container material. The material used is one which will not interact deleteriously with constituents of the nitroglycerin tablets. Preferably if the body and cap members are to be made respectively of a single material, it is a selected one of gold, stainless steel or silver with a flash coating of rhodium. Another preferred material is a metal such as brass plated with either a gold plating or a silver plating covered by a flash coating of rhodium.

A unique aspect of the container of this invention is a novle thread formation with a double pilot construction which permits the body and cap members to be brought into close alignment and then firmly secured together by relatively turning the two members approximately one and one-third revolutions. This permits ready, reliable separation of the members for emergency administration of a medication. This is true because one can effect relative rotation up to about one and one-half revolutions without regrasping the two members.

When the container is made of, or coated with, gold or silver, these materials inhibit any tendency of the threads to bond or stick together. Accordingly, even though the cap and body are firmly secured together with a good fluid-tight seal and in a manner where the connection will not vibrate loose, the two can be separated quite easily with a turn of slightly over one revolution. With this construction, a heart attack victim can, for example, disconnect the cap and container and put the entire container in his mouth even when he may in fact be passing out due to a severe attack. The saliva in the mouth will dissolve the nitroglycerin tablets and the nitroglycerin will flow through mouth tissues into the blood stream.

The double pilot arrangement is achieved through the provisions of a special and novel thread. The crests of the threads are straight in axial cross section so that the crests of both the male and female threads each lie in a different imaginary cylinder which is coaxial with the axis of the container. An annular surface is provided between the male threads which are on the container member and an end of the container member. This annular surface is a pilot surface that is slightly smaller in diameter than the female threads formed on the cap member. As the two members are brought into alignment, this container pilot surface coacts with the female threads to bring the two members into rough axial alignment.

In the preferred configuration, an annular seal is carried by the cap member between the female threads and an end to the cap. This annular seal has an internal surface which is only slightly larger in diameter than the male threads of the body member. This coaction of the seal and female threads provides a second step of the double pilot action, bringing the threads into precise axial alignment. Specially configured threads then permit the body and cap members to be connected together with one revolution, or slightly more, of thread engagement turning.

The body member has a tablet-receiving bore that extends axially from the cap-receiving end of the body. This bore is of slightly larger diameter than the largest commercially available nitroglycerin tablet and of a depth to receive a maximum of six nitroglycerin tablets in stacked, axially-aligned relationship. The base of the bore is made with a small radius of less than the corner radius of available tablets so that the corner radius will not tend to break up stored tablets.

Accordingly, the object of the invention is to provide a novel and improved medicine container. Other objects and a fuller understanding of the invention may be had by referring to the following description and claims taken in conjunction with the accompanying drawings.

DESCRIPTION OF THE PREFERRED EMBODIMENT

Figure 1:
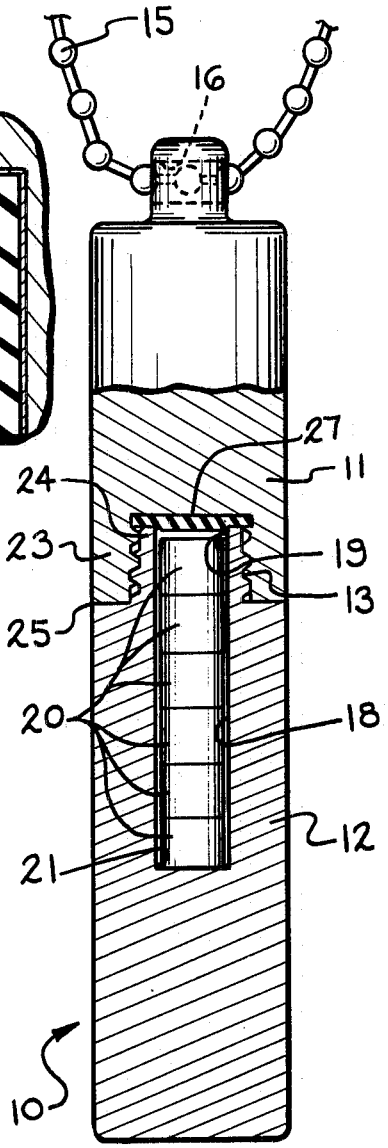
FIG. 1 is a partially sectioned elevational view of an assembled and filled container.

Referring now to the drawings and to FIG. 1 in particular, a container is shown generally at 10. The container includes cap and body members 11, 12 which are threadedly connected together at 13. In its preferred form, the container 10 is a locket which is carried by body attachment in the form of a band or a chain 15. The chain 15 passes around the neck of a wearer and through an eye 16 formed in the cap 11.

The body 12 has an axially-extending, cylindrically-contoured bore 18. The bore extends downwardly from a top opening 19 to a depth which preferably will receive a total of six nitroglycerin tablets 20 in stacked relationship. The bore 18 is sized to be slightly larger in diameter than the largest commercially-available nitroglycerin tablets but small enough in diameter to maintain the tablets in stacked relationship with a minimum of free air around them. More specifically, the cavity 18 is preferably configured for storing six cylindrical nitroglycerin tablets, each tablet having a diameter of approximately 0.16 inch and a thickness of approximately 0.12 inch. The cavity 18 is preferably cylindrical in shape, having a length of approximately 0.75 inch, and a diameter of approximately 0.165 to 0.180 inch.

The cavity 18 is configured to avoid breakage of stored nitroglycerin tablets due to stresses imposed upon the corners of the tablets. This is accomplished through the provision of a cavity corner radius at 21 which is no greater than approximately 0.005 inch. This corner radius is less than the corner radius of the corresponding corner surfaces of the generally cylindrical nitroglycerin tablets.

The cap 11 has an end portion 23 which telescopes over and threadedly engages a reduced-diameter end portion 24 of the body 12. The end portions 23, 24 respectively have radially-disposed end and shoulder surfaces which abut at 25. These end and shoulder surfaces function to limit relative connecting rotation to less than 1.5 revolutions.

A deformable disc-shaped seal 27 is provided. The seal 27 is carried by the cap 11 at the base of the bore in the end portion 23. The disc seal 27 abuts an end of the reduced-diameter body portion 24 around the end opening 19 to effect a fluid-tight seal between the body and the cap.

Figure 4:
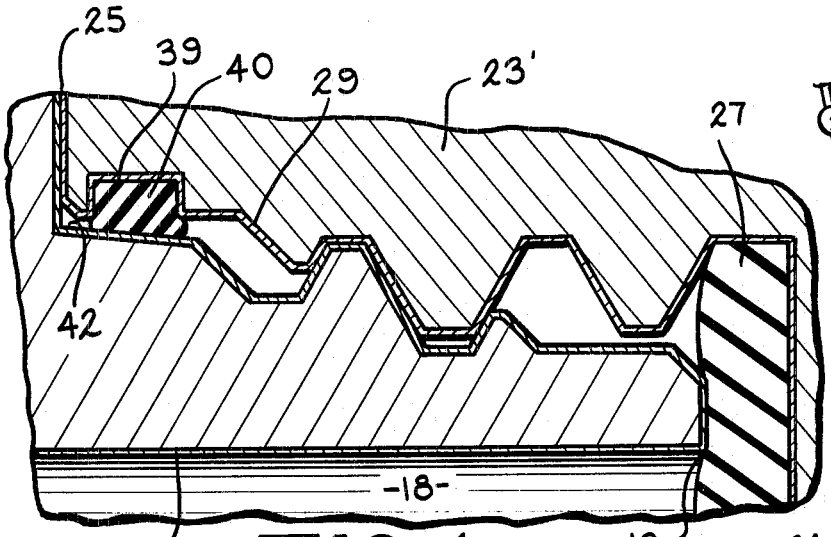
Figure 2:
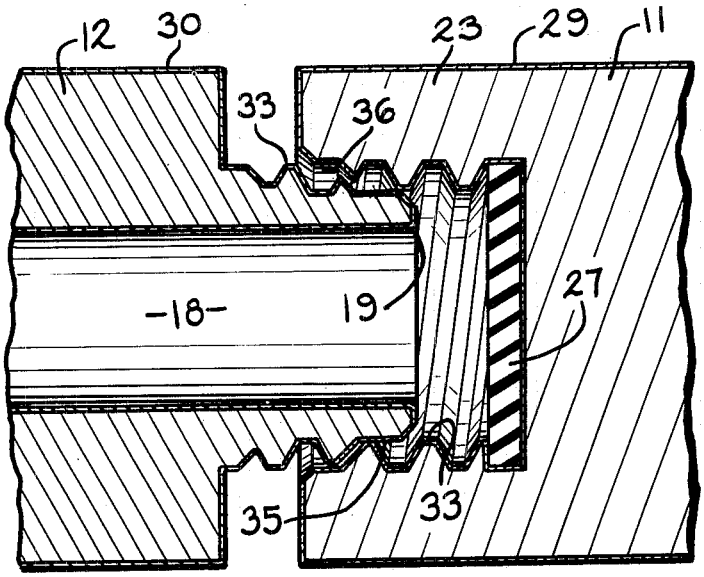
FIG. 2 is an enlarged fragmentary sectional view of the cap and body members of FIG. 1 as they are being connected or disconnected.
Figure 3:
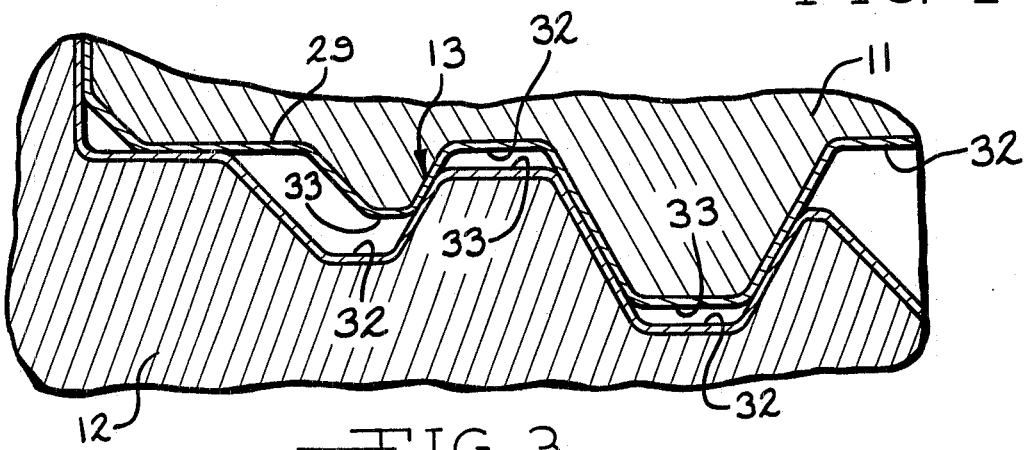
FIG. 3 is a still further enlarged fragmentary sectional view showing the threads of the embodiments of FIGS. 1 and 2 in connected relationship; and, FIG. 4 is an enlarged fragmentary sectional view showing the cap and body members of the preferred embodiment of the invention connected together.

Preferably the cap and body 11, 12 are screw machine metal members. FIGS. 1 and 4 show an embodiment of the invention made out of gold, stainless steel or silver with a flash coating of rhodium which is not shown. Each of these is inert to interaction with nitroglycerin tablets. FIGS. 2 and 3 show a plated embodiment.

When the members are formed of other than gold, stainless steel or rhodium coated silver, brass is preferred. The surfaces of the brass members 11, 12 are respectively plated with metallic layers 29, 30 containing substantial quantities of either gold or silver. The thickness of these plating layers is greatly exaggerated in the drawings for clarity of illustration. Where gold plating is employed, the inert qualities of the gold protect the brass from deterioration due to chemical reactions of the brass with active substances such as nitrous oxide, present in or produced by the stored medication. Silver is covered with a flash coating of rhodium, not shown, to provide an inert surface. This inert feature also prevents contamination of the medication in the cavity 18 by any products of such a reaction.

Preferably, the entire interior and exterior surfaces of the members 11, 12 are plated with the gold or silver of the layers 29, 30, both for decorative purposes, and because selective plating of only portions of the members 11, 12 would be difficult. The plating also provides lubricity which inhibits bonding or seizing of the threads 13. Preferably the plating layers are from 0.0001 to 0.0002 inch thick.

The end portions 23, 24 are illustrated in detail in FIGS. 2–4. Smoothness and ease of connection and separation of the members 11, 12 is enhanced by the use of threads having flattened roots and crests 32, 33. Specifically, the threads are "stub" threads having 60° flanks. The disclosed threads permit separation of the members 11, 12 with no more than about one and one-third relative revolutions.

One of the outstanding features of the invention resides in a double-pilot construction which assures alignment of the cap and body 11, 12 before the threads are rotated into locking engagement. It is this double-pilot feature which permits a secure threaded connection with only slightly more than one revolution of relative rotation between the members 11, 12.

The crests 33 of each of the end portions 23, 24 of a full size (as distinguished from a starting size) thread, respectively, lie in imaginary cylinders which are coaxial with the container. A male cylindrically-contoured surface 35 is formed on the end portion 24 between its male threads and its end, FIG. 2. This male pilot surface is of a diameter slightly less than the crests 33 of the female threads formed in the end member 23. As the two members are telescoped into the position shown in FIG. 2, it will be seen that a first pilot action will be provided by the coaction of this male pilot surface 35 and the threads of the cap end portion 23.

A female pilot section 36 is formed in the cap member 23 between its threads and its end. The female pilot section is shorter axially than the male section. As closing movement of the two members continues after they have been brought into substantial alignment by the first pilot action, the female pilot surface coacts with the thread crests 33 of the body end portion 24 to effect a second pilot action. Expressed another way, the diammetrical clearance between the female pilot surface 36 and its coacting threads is less than the clearance between the male pilot surface 35 and its coacting threads. Thus, the male pilot surface serves to bring the two members into good alignment while the female pilot surface serves to bring the two members into substantially perfect alignment before the threaded connection is effected. With this piloting action only limited threads are required because the pilots not only serve to bring the members into alignment as a connection is made, but they also serve to tend to maintain that alignment after the connection is completed.

FIG. 4 shows the preferred double-sealing container construction. Here, the female end portion 23' has an annular groove 39 formed slightly inwardly from the end surface at the abutment 25 and between the end surface and the female threads. An annular seal 40 is carried in the groove 39. When the container is fully closed as shown in FIG. 4, the annular seal 40 is deformed by the camming action of a frusto-conically shaped surface 42. This surface 42 extends from the body shoulder at the abutment 25 toward the male threads tapering inwardly in that direction.

In its undeformed condition, the seal 40 is formed to provide the female pilot surface 36. In its deformed condition as shown in FIG. 4, it effects a second seal and also functions in the manner of a lock washer to maintain the cap and body firmly secured together. The second seal 40 is formed of a material having low surface friction when engaging metal so that the container can be easily separated. The preferred material for the seal 40, like the seal 27, is Teflon.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A medicine container comprising:

(a) a pair of members defining complemental male and female portions each having pilot and threaded sections;

(b) the pilot section of one portion being axially shorter than the pilot section of the other portion;

(c) the thread of the other portion threaded section having a first crest surface of a diameter different than the one pilot section by a first amount to provide a first pilot action as the portions are brought into telescopic relationship;

(d) the thread of the one portion threaded section having a second crest surface of a diameter different than the other pilot section by a second amount less than the first to provide a second and more precise pilot action as the portions are brought into telescopic relationship;

(e) whereby to bring the threads into axial alignment prior to connecting relative rotation of the portions to connect the members.

2. The container of claim 1 wherein an annular seal is carried by a first of the members and the seal defines a first pilot section.

3. The container of claim 2 wherein the first pilot section is the section of said one portion.

4. The container of claim 2 wherein the first pilot section is said other pilot section.

5. The container of claim 1 wherein the first pilot section is the female portion pilot section.

6. The container of claim 1 wherein the second of the members has a camming surface that coacts with said seal.

7. A container for nitroglycerin tablets comprising:

(a) a container member having a cylindrical cavity sized to receive a stack of nitroglycerin tablets;

(b) a cap member for selective connection with the container member to retain a stack of nitroglycerin tablets in the cavity;

(c) a seal element carried by one of the members and coactable with both of the members when they are connected effectively to seal the cavity and inhibit deterioration of the retained tablets;

(d) the members defining complemental male and female portions each having pilot and threaded sections, the pilot section of one portion being axially shorter than the pilot section of the other portion, the thread of the other portion threaded section having a first crest surface of a diameter different than the one pilot section by a first amount to provide a first pilot action as the portions are brought into telescopic relationship, the thread of the one portion threaded section having a second crest surface of a diameter different than the other pilot section by a second amount less than the first to provide a second and more precise pilot section as the portions are brought into telescopic relationship whereby to bring the threads into axial alignment prior to connecting relative rotation of the portions to connect the members, and (e) an attachment connected to a first of the members for attaching the connected container to a person.

8. The medicine container of claim 7, wherein at least some of said threads have flatted crests.

9. The medicine container of claim 7, wherein said seal is made of a relatively soft resilient material.

10. A medicine container comprising:

(a) two separable members defining a closed cavity for containing medicine;

(b) said members having coacting threaded portions for coupling the members together selectively to close the cavity;

(c) a relatively resilient sealing member interposed between said members and substantially effecting an hermetic seal of the cavity, and (d) said members defining complemental male and female portions each having pilot and threaded sections, the pilot section of one portion being axially shorter than the pilot section of the other portion, the thread of the other portion threaded section having a first crest surface of a diameter different than the one pilot section by a first amount to provide a first pilot action as the portions are brought into telescopic relationship, the thread of the one portion threaded section having a second crest surface of a diameter different than the other pilot section by a second amount less than the first to provide a second and more precise pilot action as the portions are brought into telescopic relationship whereby to bring the threads into axial alignment prior to connecting relative rotation of the portions to connect the members.

11. The container of claim 32 wherein said threads have generally flat roots corresponding to said crest surfaces.

12. The container of claim 11 wherein said threads have generally flat crest surfaces.

13. A medicine container comprising:

(a) two separate members adapted for defining a cavity for containing medicine when the members are connected together;

(b) each member having a threaded portion cooperative with the threaded portion of the other member to provide such interconnection;

(c) the members having coactable surfaces for limiting relative connecting rotation to less than 1.5 revolutions;

(d) said threads of the two threaded portions being interconnectable in response to no more than 1.5 revolutions of relative rotation between said members, and (e) said members defining complemental male and female portions each having pilot and threaded sections; the pilot section of one portion being axially shorter than the pilot section of the other portion, the thread of the other portion threaded section having a first crest surface of a diameter different than the one pilot section by a first amount to provide a first pilot action as the portions are brought into telescopic relationship, the thread of the one portion threaded section having a second crest surface of a diameter different than the other pilot section by a second amount less than the first to provide a second and more precise pilot action as the portions are brought into telescopic relationship whereby to bring the threads into axial alignment prior to connecting relative rotation of the portions to connect the members.

14. The container of claim 13 wherein (a) said seal is made of a relatively soft resilient material, and (b) at least some of said threads have flatted crests.

* * * * *